US005453176A

United States Patent [19]

Narloch et al.

[11] Patent Number: 5,453,176

[45] Date of Patent: Sep. 26, 1995

[54] PROCESS FOR PREPARING WHITE OIL CONTAINING A HIGH PROPORTION OF ISOPARAFFINS

[76] Inventors: Bruce A. Narloch, 432 Fraga Ct., Martinez, Calif. 94553; Michael A. Shippey, 579 Thornwood, San Rafael, Calif. 94903; Malcolm W. Wilson, P.O. Box 528, Tiburon, Calif. 94920

[21] Appl. No.: 136,511

[22] Filed: Oct. 13, 1993

[51] Int. Cl.[6] ..... C10G 11/04

[52] U.S. Cl. ..... 208/58; 208/14; 208/18; 208/27; 208/268; 208/97; 208/111; 208/114

[58] Field of Search ..... 208/58, 264, 268, 208/14, 98, 27, 114, 111, 97

[56] References Cited

U.S. PATENT DOCUMENTS

| | | | |
|---|---|---|---|
| 3,553,107 | 1/1971 | Donaldson et al. | 208/271 |
| 3,818,105 | 8/1974 | Coopersmith et al. | 424/358 |
| 3,852,207 | 12/1974 | Stangeland et al. | 208/264 |
| 4,072,603 | 2/1978 | Weintzheimer | 208/58 |
| 4,240,900 | 12/1980 | Gilbert et al. | 208/264 |
| 4,251,347 | 2/1981 | Rausch et al. | 208/264 |
| 4,263,127 | 4/1981 | Rausch et al. | 208/58 |
| 4,325,804 | 4/1982 | Everett et al. | 208/58 |
| 4,689,138 | 8/1987 | Miller | 208/111 |
| 4,859,311 | 8/1989 | Miller | 208/58 |
| 4,867,862 | 9/1989 | Ziemer | 208/58 |
| 4,921,594 | 5/1990 | Miller | 208/58 |
| 5,019,662 | 5/1991 | Vora et al. | 585/323 |
| 5,027,206 | 10/1991 | Engel et al. | 208/58 |
| 5,087,347 | 2/1992 | Miller | 208/46 |
| 5,135,638 | 8/1992 | Miller | 208/27 |
| 5,139,647 | 8/1992 | Miller | 208/100 |
| 5,149,421 | 9/1992 | Miller | 208/114 |
| 5,246,565 | 9/1993 | Miller | 208/27 |
| 5,294,327 | 3/1994 | Everett | 208/57 |

FOREIGN PATENT DOCUMENTS

| | | |
|---|---|---|
| 0323724 | 7/1989 | European Pat. Off. . |
| 1204012 | 9/1970 | United Kingdom . |
| 1310320 | 3/1973 | United Kingdom . |
| 1476428 | 6/1977 | United Kingdom . |
| WO91/08276 | 6/1991 | WIPO . |

OTHER PUBLICATIONS

Lecomte et al., "For White Oil Purify: Hydrogenate", Hydrocarbon Processing, Apr. 1977.

Galli et al., "A New Synthetic Food Grade White Oil", Presented at the 36th ASLE Annual Meeting in Pittsburgh, Pa., May 11–14, 1981.

EXXSYN 6 Synthetic Lubriant Basestock, Sales Brochure from Esso Petroleum Co. Ltd., Lubricantes Div., No. 192/93/500 Aug. 1991.

*Primary Examiner*—Helane Myers

*Attorney, Agent, or Firm*—V. J. Cavalieri; A. W. Klaassen

[57] ABSTRACT

A process is disclosed for producing an isoparaffin white oil by contacting a refinery stream, in the presence of hydrogen, with a catalyst comprising an intermediate pore size silicoaluminophosphate molecular sieve and a hydrogenation component to form a dewaxed oil product. The dewaxed oil product is then contacted with a hydrogenation catalyst to produce a hydrogenated oil product which is then treated to remove aromatics to produce an isoparaffin white oil.

32 Claims, No Drawings

PROCESS FOR PREPARING WHITE OIL CONTAINING A HIGH PROPORTION OF ISOPARAFFINS

BACKGROUND OF THE INVENTION

The present invention relates to a process for preparing an isoparaffin white oil. It more particularly relates to a process for preparing a low normal paraffin white oil from a refinery stream using an intermediate pore size silicoaluminophosphate molecular sieve.

White mineral oils are highly refined oils which may become part of food either by direct addition or by incidental contact. Two regulations specify properties of food grade white mineral oil:

a. 21 CFR 172,878 governs direct food addition permitted in food for human consumption; and b. 21 CFR 178.3620(a) governs food additives resulting from contact with containers or equipment.

These two regulations require that the white oil meet test requirements for readily carbonizable substances, for sulfur compounds, and for maximum ultraviolet absorbance limits.

Technical white mineral oils, defined in 21 CFR 178.3620(b), must meet minimum +20 Saybolt color and less stringent ultraviolet absorbance limits using test methods for food grade white oil described above.

A second grade of technical white mineral oil, defined in 21 CFR 178.3620(c) for use as a component of non-food articles, must meet minimum initial boiling point, maximum color and maximum ultraviolet absorbance limits.

Because of the severe requirement for white oils, many commercial processes use purified feed streams in white oil manufacture. For example, International Publication WO 91/08276, filed Dec. 5, 1990, discloses isomerization of isoolefins followed by hydrogenation to form an isoparaffin white oil. Hydrogenation of a polymerized olefin to form white oils is also taught in GB 1,204,012, filed Jul. 31, 1968. A two-stage hydrogen treatment of wax to prepare white oils is taught in GB 1,476,428, filed Jul. 3, 1973.

A number of processes for preparing white oils from petroleum feedstock have also been disclosed. For example, in U.S. Pat. No. 3,553,107, white oils are prepared by subjecting lubricating oil stock first to hydrogenation and then to acid treating using fuming sulfuric acid. GB 1,310,320 describes a three-step process for producing technical white mineral oil from a raw, waxy mineral lubricating oil distillate: (1) a hydrogenation step at 600°–800° F.; (2) a hydroisomerization-hydrocracking step using a crystalline aluminosilicate-containing catalyst; and (3) a hydrogenation step over a platinum group metal hydrogenation catalyst to saturate aromatics and to produce technical white oil.

Recent toxicological research in rats exposed to white oils of varying viscosity and process history in controlled feeding studies demonstrated that hydrocarbons from certain of these oils accumulate in physiologically important organs, including the liver. Physiological changes in the tissues and organs which accumulated hydrocarbons included histiocytosis and granulomatous lesions. Chemical composition and viscosity considerations for the oils tested suggest that the accumulated hydrocarbons may be medium molecular weight n-paraffins. Additional studies in laboratory animals have demonstrated that n-alkanes are apparently more readily absorbed than branched and cyclic alkanes. While the relevance of these studies to humans has not yet been determined, these findings suggest that white oils currently used in the manufacture of foods for human consumption may warrant concern. There is a need, therefore to decrease the normal paraffin content and/or increase the isoparaffin content of white oils.

While isoparaffin white oils have been prepared as noted above, conventional processes for preparing white oils from refinery streams are inadequate for reducing the normal paraffin content of the white oils by selectively isomerizing the normal paraffins to isoparaffins.

SUMMARY OF THE INVENTION

According to the invention, a process is provided for preparing a white oil having a low normal paraffin content. Further to the invention, a process is provided for preparing a low normal paraffin white oil from a refinery stream, which process comprises isomerizing the paraffins in the refinery stream. More specifically, the present invention is directed to a process for producing a low normal paraffin white oil from a refinery stream, which process comprises:

a. contacting, under dewaxing conditions, a refinery stream boiling above 350° F. and containing straight chain and slightly branched chain hydrocarbons in the presence of added hydrogen with a catalyst comprising:

i. an intermediate pore size silicoaluminophosphate molecular sieve, and ii. a hydrogenation component; to produce a dewaxed oil product;

b. be contacting under hydrogenation conditions said dewaxed oil product in a first hydrogenation stage in the presence of a hydrogenation catalyst to produce a hydrogenated oil product; and c. treating said hydrogenated oil product at aromatics removal conditions to produce an isoparaffin white oil.

The refinery stream which is the feedstock to the present process boils above about 350° F., preferably above about 450° F., and more preferably above about 550° F. The refinery stream may be prepared by any method known in the art of refinery processes. A preferred feedstock to the present process is a lube oil feedstock, which has been upgraded by an initial treatment step to remove aromatics, sulfur-, nitrogen-, and oxygen-containing molecules using hydroconversion or solvent extraction processes.

In the present process, the feedstock is both dewaxed and isomerized using an intermediate pore size silicoaluminophosphate molecular sieve, which has properties for both removing waxy molecules from the feedstock and selectively isomerizing the normal paraffins in the feedstock to isoparaffins which boil in the same boiling range as the normal paraffins from which they are made. Preferred intermediate pore size silicoaluminophosphate molecular sieves are SAPO-11, SAPO-31, and SAPO-41, most preferably SAPO-11.

The treating step for removing aromatics from the hydrogenated oil product may be one or more processes known to the art for removing aromatics to very low levels in the production of white oils. Such processes include a second hydrogenation stage, an acid treatment step or a clay treatment step. It will be recognized that removing aromatics from the white oil in the treating step may also include removal of sources of color and odor from the hydrogenated oil product during production of the isoparaffin white oil.

The white oil produced in the present process has a high isoparaffin content relative to conventional processes for preparing white oils from refinery streams. Furthermore, the white oil of the present process is enriched in isoparaffins relative to the refinery stream from which it is made.

Among other factors, we have discovered a process for converting a refinery stream at high yield, using a catalyst which is selective for the production of isoparaffins, into an isoparaffin white oil.

DETAILED DESCRIPTION OF THE INVENTION

Reference will now be made in detail to the preferred embodiments of Applicants' invention.

White Oil

The white oil produced in the present process is characterized by a high isoparaffin content and a reduced normal paraffin content relative to white oils prepared from refinery streams using conventional methods. The white oil as produced by the present method may therefore be used in applications where a low normal paraffin containing oil is desirable, as in food manufacture or processing. Accordingly, the white oil produced as described herein contains an isoparaffin/total paraffin weight ratio of greater than about 0.4/1, and preferably greater than about 0.5/1. Thus, isoparaffins (ie. branched alkanes) comprise greater than about 40 weight percent, and preferably greater than about 50 weight percent, of the total paraffins (including branched and linear, nonbranched alkanes) in the isoparaffin white oil.

The typical total paraffin content of the white oil is greater than 5% by weight, preferably greater than 10% by weight, and more preferably greater than 30% by weight of the oil.

Total paraffin content of the white oil may be determined using the analysis method described in ASTMD-2786. The content of n-paraffins may be determined using the following gas chromatographic (GC) technique. A baseline test is made to determine the retention times of a known mixture of $C_{20}$ to $C_{40}$ normal paraffins. To make the determination, approximately 5 ml of carbon disulfide is added to a weighed amount of the known mixture in a 2-dram vial. Two microliters of the $CS_2$/known sample are injected into an HP-5711 gas chromatograph, which is operated using the following parameters:

| | |
|---|---|
| Carrier gas - helium | Column - 15 m × 0.32 mm ID |
| Splitter flow - 50 ml/min | fused silica capillary |
| Inlet pressure - 30 psig | coated with DB-1. |
| Make-up gas - nitrogen | Available from J&W |
| Make-up flow - 25 ml/min | Scientific. |
| (@ 8 psig) | |
| FID hydrogen - 20 ml/min | Oven Temperature Program - |
| (@ 16 psig) | (150° C. initial, 4 min. |
| FID air - 300 ml/min | delay, 4° C./min rate, 270° C. |
| (40 psig) | final temp, 26-min final |
| Injector Temperature - 350° C. | temp hold. |
| Detector Temperature - 300° C. | |

The peaks in the resulting GC trace are correlated with the identity of each of the normal paraffins in the known mixture.

The gas chromatographic analysis is then repeated on a sample of the unknown white oil. A weighted amount of the unknown white oil is dissolved in 5 ml of $CS_2$ and the solution injected into the gas chromatograph, which is operated using the parameters listed above. The resulting GC trace is analyzed as follows:

(a) Each peak attributable to each normal paraffin $C_x$ present in the white oil is identified.

(b) The relative area of each normal paraffin peak is determined by standard integration methods. Note that only the portion of the peak directly attributable to the normal paraffin, and excluding the envelope at the base of the peak attributable to other hydrocarbons, is included in this integration.

(c) The relative area representing the total amount of each hydrocarbon $C_n$ (both normal and non normal) in the white oil sample is determined from a peak integration from the end of the $C_{n-1}$ normal paraffin peak to the end of the $C_n$ peak. The weight percentage of each normal paraffin in the white oil is determined by relating the area of the normal paraffin peak to the total area attributable to each carbon number component in the white oil.

The white oil produced in the present process also meets the requirements of regulation 21 CFR 172.878, 21 CFR 18 178.3620(a), 21 CFR 178.3620(b) or 21 CFR 178.3620(c) for food grade and technical grade white oils, which regulations are incorporated herein by reference. Food grade white mineral oil is required to be colorless, odorless when cold, tasteless, insoluble in water and alcohol, nearly free of fluorescence and neutral to litmus. It must also pass tests for readily carbonizable substances, for polynuclear compounds and for 0° C. solid paraffins. Technical white oils meet somewhat less severe requirements. The white oil produced by the present process has a normal boiling point above 350° F., preferably above 450° F., and more preferably above 550° F. and has a viscosity which falls in a broad range from about 8 to about 120 cSt at 40° C. Generally, the white oil is classified by viscosity grade. For example, white oils prepared by the present process include oils having a viscosity in the range of from 8 to 10 cSt at 40° C. oils having a viscosity in the range of from 10 to 18 cSt at 40° C., oils having a viscosity in the range of from 18 to 21 cSt at 40° C., oils having a viscosity in the range of from 21 to 45 cSt at 40° C., oils having a viscosity in the range of from 45 to 49 cSt at 40° C., oils having a viscosity in the range of from 49 to 90 cSt at 40° C., oils having a viscosity in the range of from 90 to 110 cSt at 40° C., and oils having a viscosity greater than 110 cSt at 40° C. Though it is not required for all white oils, it may be preferable in some cases that the viscosity index of the dewaxed oil product be at least about 70, preferably at least about 60, more preferably at least about 80, and still more preferably at least about 95.

Feedstock

The refinery stream from which the white oil is prepared in the present process ranges from relatively light distillate fractions up to high boiling stocks such as whole crude petroleum, reduced crudes, vacuum tower residua, cycle oils, synthetic crudes (e.g., shale oils, tar sand oil, etc.), gas oils, vacuum gas oils, foots oils, and other heavy oils. Oils normally used in the conventional preparation of white oils may be treated in the present process. The feedstock will normally be a $C_{10+}$ feedstock generally boiling above about 350° F. since lighter oils will produce smaller amounts of commercially useful white oils. The process is particularly useful with waxy distillate stocks such as lubricating oil stocks. Hydroprocessed stocks are a convenient source of stocks of this kind since they normally contain significant amounts of waxy n-paraffins. The feedstock of the present process will normally be a $C_{10+}$ feedstock containing paraffins, olefins, naphthenes, aromatics and heterocyclic compounds and a substantial proportion of higher molecular weight n-paraffins and slightly branched paraffins which contribute to the waxy nature of the feedstock. During dewaxing using the dewaxing catalyst of the present process, the n-paraffins and slightly branched paraffins undergo isomerization and some cracking or hydrocracking to form liquid range materials which contribute to a low viscosity product. The degree of cracking which occurs is, however, limited so that the gas yield is reduced, thereby preserving the economic value of the feedstock.

Catalytic Dewaxing Process Conditions

Waxy components are removed from the refinery stream in the present process by a catalytic dewaxing step. During dewaxing, a substantial portion of the waxy components are hydroisomerized in the presence of the dewaxing catalyst of the present process to form isoparaffinic components with boiling points approximately the same as the boiling points of the normal paraffins from which they are made. The catalytic dewaxing step of the invention may be conducted by contacting the feed to be dewaxed with a fixed stationary bed of catalyst, with a fixed fluidized bed, or with a transport bed, as desired. A simple and therefore preferred configuration is a trickle-bed operation in which the feed is allowed to trickle through a stationary fixed bed, preferably in the presence of hydrogen.

The catalytic dewaxing conditions employed depend on the feed used and the desired pour point. Generally, the temperature is from about 200° C. to about 475° C., preferably from about 250° C. to about 450° C. The pressure is typically from about 15 psig to about 3000 psig, preferably from about 200 psig to 3000 psig. The liquid hourly space velocity (LHSV) preferably will be from 0.1 to 20, preferably from about 0.2 to 10.

Hydrogen is preferably present in the reaction zone during the catalytic dewaxing process. The hydrogen to feed ratio is typically between about 500 and about 30,000 SCF/bbl (standard cubic feet per barrel), preferably from about 1000 to about 20,000 SCF/bbl. Generally, hydrogen will be separated from the product and recycled to the reaction zone.

While the dewaxing process can be practiced with utility when the feed contains organic nitrogen (nitrogen-containing impurities), it is preferred that the organic nitrogen content of the feed be less than 50 ppm (w/w), more preferably less than 10 ppm (w/w). Particularly good results, in terms of activity and length of catalyst life or catalyst cycle (period between successive regenerations or startup and first regeneration), are experienced when the feed contains less than 10 ppm (w/w) of organic nitrogen.

In the present process, the white oils are prepared with a sufficiently low pour point to remain liquid during use as a white oil. Thus, the dewaxed oil product will have a pour point lower than that of the refinery stream which is the feedstock to the dewaxing step. Generally, the dewaxed oil product will have a pour point of less than 10° C., often less than 0° C., and more preferably less than −5° C. In some applications, the present process may be used to prepare white oils having a pour point of less than −15° C. with good yield.

Silicoaluminophosphate Molecular Sieve Catalyst Compositions (SAPOs)

Central to the present process is a step of dewaxing, using an intermediate pore size silicoaluminophosphate molecular sieve, which is highly selective for converting waxy components into non-waxy isoparaffinic analogues of the converted waxes. U.S. Pat. Nos. 4,859,311; 4,921,594 and 5,149,421 teach dewaxing processes using an intermediate pore size silicoaluminophosphate molecular sieve. The disclosure of each of these, and in particular the disclosure of the dewaxing processes, is incorporated herein by reference. U.S. Pat. No. 5,082,986 describes a method for isomerizing an olefin feed over an intermediate pour size silicoaluminophosphate molecular sieve and a Group VIII metal to make a $C_{20+}$ lube oil. The disclosure of U.S. Pat. No. 5,082,986, and in particular the disclosure of the dewaxing process, is incorporated herein by reference.

The dewaxing catalyst employed in the process of the invention has an acidic component and a hydrogenation component. The acidic component comprises an intermediate pore size silicoaluminophosphate molecular sieve which is described in U.S. Pat. No. 4,440,871, the pertinent disclosure of which is incorporated herein by reference. The preferred intermediate pore size silicoaluminophosphate molecular sieves suitable for use in the process of this invention include SAPO-11, SAPO-31 and SAPO-41.

SAPO-11 comprises a silicoaluminophosphate material having a three-dimensional microporous crystal framework structure of $[PO_2]$, $[AlO_2]$ and $[SiO_2]$ tetrahedral units whose unit empirical formula on an anhydrous basis is:

$$mR:(Si_xAl_yP_z)O_2$$

wherein "R" represents at least one organic templating agent present in the intracrystalline pore system; "m" represents the moles of "R" present per mole of $(Si_xAl_yP_z)O_2$ and has a value of from zero to about 0.3; "x", "y" and "z" represent, respectively, the mole fractions of silicon, aluminum and phosphorus, said mole fractions being such that x, y and z are each greater than 0.01 and x+y+z= 1.0. The silicoaluminophosphate molecular sieve has a characteristic X-ray powder diffraction pattern which contains at least the d-spacings (as-synthesized and calcined) set forth below in Table I. When SAPO-11 is in the as-synthesized form, "m" preferably has a value of from 0.02 to 0.3.

TABLE I

| 2θ | d | Relative Intensity |
|---|---|---|
| 9.5–9.65 | 9.41–9.17 | m |
| 20.3–20.6 | 4.37–4.31 | m |
| 21.0–21.3 | 4.23–4.17 | vs |
| 22.1–22.35 | 4.02–3.99 | m |
| 22.5–22.9 (doublet) | 3.95–3.92 | m |
| 23.15–23.35 | 3.84–3.81 | m-s |

All of the as-synthesized SAPO-11 compositions for which X-ray powder diffraction data have been obtained to date have patterns which are within the generalized pattern of the Table II below.

TABLE II

| 2θ | d | $100 \times I/I_o$ |
|---|---|---|
| 8.05–8.3 | 10.98–10.65 | 20–42 |
| 9.4–9.65 | 9.41–9.17 | 36–58 |
| 13.1–13.4 | 6.76–6.61 | 12–16 |
| 15.6–15.85 | 5.68–5.59 | 23–38 |
| 16.2–16.4 | 5.47–5.40 | 3–5 |
| 18.95–19.2 | 4.68–4.62 | 5–6 |
| 20.3–20.6 | 4.37–4.31 | 36–49 |
| 21.0–21.3 | 4.23–4.17 | 100 |
| 22.1–22.35 | 4.02–3.99 | 47–59 |
| 22.5–22.9 (doublet) | 3.95–3.92 | 55–60 |
| 23.15–23.35 | 3.84–3.81 | 64–74 |

TABLE II-continued

| 2θ | d | 100 × I/I$_o$ |
|---|---|---|
| 24.5–24.9 (doublet) | 3.63–3.58 | 7–10 |
| 26.4–26.8 (doublet) | 3.38–3.33 | 11–19 |
| 27.2–27.3 | 3.28–3.27 | 0–1 |
| 28.3–28.5 (shoulder) | 3.15–3.13 | 11–17 |
| 28.6–28.85 | 3.121–3.094 | |
| 29.0–29.2 | 3.079–3.058 | 0–3 |
| 29.45–29.65 | 3.033–3.013 | 5–7 |
| 31.45–31.7 | 2.846–2.823 | 7–9 |
| 32.8–33.1 | 2.730–2.706 | 11–14 |
| 34.1–34.4 | 2.629–2.607 | 7–9 |
| 35.7–36.0 | 2.515–2.495 | 0–3 |
| 36.3–36.7 | 2.475–2.449 | 3–4 |
| 37.5–38.0 (doublet) | 2.398–2.368 | 10–13 |
| 39.3–39.55 | 2.292–2.279 | 2–3 |
| 40.3 | 2.238 | 0–2 |
| 42.2–42.4 | 2.141–2.132 | 0–2 |
| 42.8–43.1 | 2.113–2.099 | 3–6 |
| 44.8–45.2 (doublet) | 2.023–2.006 | 3–5 |
| 45.9–46.1 | 1.977–1.969 | 0–2 |
| 46.8–47.1 | 1.941–1.929 | 0–1 |
| 48.7–49.0 | 1.870–1.859 | 2–3 |
| 50.5–50.8 | 1.807–1.797 | 3–4 |
| 54.6–54.8 | 1.681–1.675 | 2–3 |
| 55.4–55.7 | 1.658–1.650 | 0–2 |

SAPO-31, another preferred intermediate pore size silicoaluminophosphate molecular sieve preferably employed in the process of the invention, comprises a silicoaluminophosphate having a three-dimensional microporous crystal framework of [$PO_2$], [$AlO_2$] and [$SiO_2$] tetrahedral units whose unit empirical formula on an anhydrous basis is:

$$mR:(Si_xAl_yP_z)O_2$$

wherein R represents at least one organic templating agent present in the intracrystalline pore system; "m" represents the moles of "R" present per mole of $(Si_2Al_yP_z)O_2$ and has a value of from zero to 0.3; "x", "y" and "z" represent, respectively, the mole fractions of silicon, aluminum and phosphorus, said mole fractions being such that x, y and z are each greater than 0.01 and x+y+z= 1.0, said silicoaluminophosphate having a characteristic X-ray powder diffraction pattern (as-synthesized and calcined) which contains at least the d-spacings set forth below in Table III. When SAPO-31 is in the as-synthesized form, "m" preferably has a value of from 0.02 to 0.3.

TABLE III

| 2θ | d | Relative Intensity |
|---|---|---|
| 8.5–8.6 | 10.40–10.28 | m-s |
| 20.2–20.3 | 4.40–4.37 | m |
| 21.9–22.1 | 4.06–4.02 | w-m |
| 22.6–22.7 | 3.93–3.92 | vs |
| 31.7–31.8 | 2.823–2.814 | w-m |

All of the as-synthesized SAPO-31 compositions for which X-ray powder diffraction data have presently been obtained have patterns which are within the generalized pattern of Table IV below.

TABLE IV

| 2θ | d | 100 × I/I$_o$ |
|---|---|---|
| 6.1 | 14.5 | 0–1 |
| 8.5–8.6* | 10.40–10.28 | 60–72 |
| 9.5 | 9.31 | 7–14 |

TABLE IV-continued

| 2θ | d | 100 × I/I$_o$ |
|---|---|---|
| 13.2–13.3* | 6.71–6.66 | 1–4 |
| 14.7–14.8 | 6.03–5.99 | 1–2 |
| 15.7–15.8* | 5.64–5.61 | 1–8 |
| 17.05–17.1 | 5.20–5.19 | 2–4 |
| 18.3–18.4 | 4.85–4.82 | 2–3 |
| 20.2–20.3 | 4.40–4.37 | 44–55 |
| 21.2–21.2* | 4.21–4.19 | 6–28 |
| 21.9–22.1* | 4.06–4.02 | 32–38 |
| 22.6–22.7* | 3.93–3.92 | 100 |
| 23.3–23.35* | 3.818–3.810 | 2–20 |
| 25.1* | 3.548 | 3–4 |
| 25.65–25.75 | 3.473–3.460 | 2–3 |
| 26.5* | 3.363 | 1–4 |
| 27.9–28.0 | 3.198–3.187 | 8–10 |
| 28.7* | 3.110 | 0–2 |
| 29.7 | 3.008 | 4–5 |
| 31.7–31.8 | 2.823–2.814 | 15–18 |
| 32.9–33.0* | 2.722–2.714 | 0–3 |
| 35.1–35.2 | 2.557–2.550 | 5–8 |
| 36.0–36.1 | 2.495–2.488 | 1–2 |
| 37.2 | 2.417 | 1–2 |
| 37.9–38.1* | 2.374–2.362 | 2–4 |
| 39.3 | 2.292 | 2–3 |
| 43.0–43.1* | 2.103–2.100 | 1 |
| 44.8–45.2* | 2.023–2.006 | 1 |
| 46.6 | 1.949 | 1–2 |
| 47.4–47.5 | 1.918 | 1 |
| 48.6–48.7 | 1.873–1.870 | 2 |
| 50.7–50.8 | 1.801–1.797 | 1 |
| 51.6–51.7 | 1.771–1.768 | 2–3 |
| 55.4–55.5 | 1.658–1.656 | 1 |

*Possibly contains peak from a minor impurity.

SAPO-41, an intermediate pore size silicoaluminophosphate molecular sieve also preferred for use in the process of the invention, comprises a silicoaluminophosphate having a three-dimensional microporous crystal framework structure of [$PO_2$], [$AlO_2$] and [$SiO_2$] tetrahedral units whose unit empirical formula on an anhydrous basis is:

$$mR: (Si_xAl_yP_z)O_2$$

wherein "R" represents at least one organic templating agent present in the intracrystalline pore system; "m" represents the moles of "R" present per mole of $(Si_xAl_yP_z)O_2$ and has a value of from zero to about 0.3; "x", "y" and "z" represent respectively, the mole fractions of silicon, aluminum and phosphorus, said mole fractions being such that x, y and z are each greater than 0.01 and x+y+z= 1.0, said silicoaluminophosphate having a characteristic X-ray powder diffraction pattern (as-synthesized and calcined) which contains at least the d-spacings set forth below in Table V. When SAPO-41 is in the as-synthesized form, "m" preferably has a value of from 0.02 to 0.3.

TABLE V

| 2θ | d | Relative Intensity |
|---|---|---|
| 13.6–13.8 | 6.51–6.42 | w-m |
| 20.5–20.6 | 4.33–4.31 | w-m |
| 21.1–21.3 | 4.21–4.17 | vs |
| 22.1–22.3 | 4.02–3.99 | m-s |
| 22.8–23.0 | 3.90–3.86 | m |
| 23.1–23.4 | 3.82–3.80 | w-m |
| 25.5–25.9 | 3.493–3.44 | w-m |

All of the as-synthesized SAPO-41 compositions for which X-ray powder diffraction data have presently been obtained have patterns which are within the generalized pattern of Table VI below.

TABLE VI

| 2θ | d | 100 × I/I$_o$ |
|---|---|---|
| 6.7–6.8 | 13.19–12.99 | 15–24 |
| 9.6–9.7 | 9.21–9.11 | 12–25 |
| 13.6–13.8 | 6.51–6.42 | 10–28 |
| 18.2–18.3 | 4.87–4.85 | 8–10 |
| 20.5–20.6 | 4.33–4.31 | 10–32 |
| 21.1–21.3 | 4.21–4.17 | 100 |
| 22.1–22.3 | 4.02–3.99 | 45–82 |
| 22.8–23.0 | 3.90–3.87 | 43–58 |
| 23.1–23.4 | 3.82–3.80 | 20–30 |
| 25.2–25.5 | 3.53–3.49 | 8–20 |
| 25.5–25.9 | 3.493–3.44 | 12–28 |
| 29.3–29.5 | 3.048–3.028 | 17–23 |
| 31.4–31.6 | 2.849–2.831 | 5–10 |
| 33.1–33.3 | 2.706–2.690 | 5–7 |
| 37.6–37.9 | 2.392–2.374 | 10–15 |
| 38.1–38.3 | 2.362–2.350 | 7–10 |
| 39.6–39.8 | 2.276–2.265 | 2–5 |
| 31.8–32.0 | 2.113–2.103 | 5–8 |
| 49.0–49.3 | 1.856–1.848 | 1–8 |
| 51.5 | 1.774 | 0–8 |

The process of the invention may also be carried out by using a catalyst comprising an intermediate pore size nonzeolitic molecular sieve containing $AlO_2$ and $PO_2$ tetrahedral oxide units, and at least one Group VIII metal. Exemplary suitable intermediate pore size nonzeolitic molecular sieves are set forth in European Patent Application No. 158,977, which is incorporated herein by reference.

By "intermediate pore size" as used herein, is meant an effective pore aperture in the range of about 5.3 to 6.5 Angstroms when the molecular sieve is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as the faujasites and mordenites, they can differentiate between n-alkanes and slightly branched alkanes on the one hand and larger branched alkanes having, for example, quaternary carbon atoms.

The effective pore size of the molecular sieves can be measured using standard adsorption techniques and hydrocarbonaceous compounds of known minimum kinetic diameters. See Breck, *Zeolite Molecular Sieves,* 1974 (especially Chapter 8); Anderson et al., J. Catalysis 58, 114 (1979); and U.S. Pat. No. 4,440,871, all of which are incorporated herein by reference.

Intermediate pore size molecular sieves will typically admit molecules having kinetic diameters of 5.3 to 6 Angstroms with little hindrance. Examples of such compounds (and their kinetic diameters in Angstroms) are: n-hexane (4.3), 3-methylpentane (5.5), benzene (5.85), and toluene (5.8). Compounds having kinetic diameters of about 6 to 6.5 Angstroms can be admitted into the pores, depending on the particular sieve, but do not penetrate as quickly and in some cases are effectively excluded. Compounds having kinetic diameters in the range of 6 to 6.5 Angstroms include: cyclohexane (6.0), 2,3-dimethylbutane (6.1), and m-xylene (6.1). Generally, compounds having kinetic diameters of greater than about 6.5 Angstroms do not penetrate the pore apertures and thus are not absorbed into the interior of the molecular sieve lattice. Examples of such larger compounds include: o-xylene (6.8), 1,3,5-trimethylbenzene (7.5), and tributylamine (8.1). The preferred effective pore size is from about 5.5 to about 6.2 Angstroms.

In performing adsorption measurements to determine pore size, standard techniques are used. It is convenient to consider a particular molecule as excluded if it does not reach at least 95% of its equilibrium adsorption value on the molecular sieve in less than about 10 minutes (p/po=0.5; 25° C).

The intermediate pore size molecular sieve is used in admixture with at least one Group VIII metal. Preferably, the Group VIII metal is selected from the group consisting of at least one of platinum and palladium, and optionally, other catalytically active metals such as molybdenum, nickel, vanadium, cobalt, tungsten, zinc, and mixtures thereof. More preferably, the Group VIII metal is selected from the group consisting of at least one of platinum and palladium. The amount of metal ranges from about 0.01% to about 10% by weight of the molecular sieve, preferably from about 0.2% to about 5% by weight of the molecular sieve. The techniques of introducing catalytically active metals into a molecular sieve are disclosed in the literature, and preexisting metal incorporation techniques and treatment of the molecular sieve to form an active catalyst such as ion exchange, impregnation or occlusion during sieve preparation are suitable for use in the present process. Such techniques are disclosed in U.S. Pat. Nos. 3,236,761; 3,226,339; 3,236,762; 3,620,960; 3,373,109; 4,202,996; 4,440,781; and 4,710,485, which are incorporated herein by reference.

The term "metal" or "active metal" as used herein means one or more metals in the elemental state or in some form such as sulfide, oxide and mixtures thereof. Regardless of the state in which the metallic component actually exists, the concentrations are computed as if they existed in the elemental state.

The physical form of the silicoaluminophosphate molecular sieve and the aluminosilicate zeolite catalysts depend on the type of catalytic reactor being employed and may be in the form of a granule or powder, and is desirably compacted into a more readily usable form (e.g., larger agglomerates), usually with a silica or alumina binder for fluidized bed reaction, or pills, prills, spheres, extrudates, or other shapes of controlled size to accord adequate catalyst-reactant contact. The catalyst may be employed either as a fluidized catalyst, or in a fixed or moving bed, and in one or more reaction stages.

The intermediate pore size molecular sieve can be manufactured into a wide variety of physical forms. The molecular sieve can be in the form of a powder, a granule, or a molded product, such as an extrudate having a particle size sufficient to pass through a 2-mesh (Tyler) screen and be retained on a 40-mesh (Tyler) screen. In cases wherein the catalyst is molded, such as by extrusion with a binder, the silicoaluminophosphate can be extruded before drying, or dried or partially dried and then extruded.

In a preferred embodiment, the final catalyst will be a composite and includes an intermediate pore size silicoaluminophosphate molecular sieve, a platinum or palladium hydrogenation metal component and an inorganic oxide matrix. The most preferred silicoaluminophosphate is SAPO-11, the most preferred metal component is platinum, and the most preferred support is alumina.

Hydrogenating the Dewaxed Oil

It is often desirable to use mild hydrogenation, referred to as hydrofinishing, to produce white oils. The hydrofinishing step can be performed after the dewaxing step. Hydrofinishing is typically conducted at temperatures ranging from about 190° C. to about 370° C., at pressures of from about 400 psig to about 3000 psig, at space velocities (LHSV) of from about 0.1 to about 20, and hydrogen recycle rates of from about 400 to about 1500 SCF/bbl. The hydrogenation catalyst employed must be active enough not only to hydrogenate the olefins, diolefins and color bodies within the white oil fractions, but also to reduce the content of any aromatics present to a suitably low level.

Suitable hydrogenation catalysts include conventional, metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly preferred hydrogenation metal. If desired, non-noble Group VIII metals can be used with molybdates. Metal oxides or sulfides can be used. Suitable catalysts are disclosed in U.S. Pat. Nos. 3,852,207; 4,157,294; 3,904,513; and 4,673,487, which are incorporated herein by reference.

The hydrofinishing step is beneficial as a first stage in removing aromatics, color bodies, and sources of odor which must be removed before the product will qualify as a technical or feed grade white mineral oil. Depending on the quality of the refinery stream feedstock to the present white oil process or the severity of the processing conditions of the dewaxing step and/or the hydrogenation step, the hydrogenated oil product from the hydrogenation step may meet some or all the requirements of at least one of regulations 21 CFR 172.878, 21 CFR 178.3620(a), 21 CFR 178.3620(b) or 21 CFR 178.3620(c) for food grade and technical grade white oils. However, in view of the severe requirements for white oils, it is preferred that the hydrogenated oil product be treated in an additional step to insure that most if not all of the remaining undesirable components are removed from the oil.

Treating the Hydrogenated Oil to Remove Aromatics

The hydrogenated oil product from the hydrogenation step is thus further treated in the process of this invention to meet the requirements set forth for a white mineral oil. This treatment step largely removes aromatics to improve the UV properties of the oil. In this process, molecules giving odor and color to the oil are also removed.

Processes for treating the oil to remove aromatics are known to the art, and include such processes as hydrotreating, acid treating, solid adsorbent filtering, or combinations thereof. Thus, treatment with a solid adsorbent may optionally be performed after the catalytic hydrogenation treatment. Examples of suitable solid adsorbents include bauxite, Fuller's earth, attapulgite, montmorillonite, halloysite, sepiolite, and other clays having adsorption and decolorizing properties, whether or not activated with acid. The solid adsorbent used for filtering the oil is generally in the particle size range of 250–2000 microns. If desired, the oil may be heated during the treatment with the solid adsorbent, preferably in the range of 350° C. to 300° C. more preferably in the range of 50° C. to 120° C., and an inert gas such as nitrogen passed through the oil. As a rule, the quantity of oil treated by the solid adsorbent according to the present process lies between 20,000 gallons of oil per ton of adsorbent to about 80,000 gallons of oil per ton of adsorbent before the adsorbent must be regenerated or replaced.

The hydrogenated material of substantially reduced aromatic content may also be subjected to an acid treatment or acid "dump" by contacting it with fuming sulfuric acid or oleum containing up to about 20 percent free $SO_3$. This acid contacting step can be conducted at a temperature in the range from about 80° F. to about 250° F. and preferably from about 100° F. to about 200° F. Normally, atmospheric pressure will be employed. The acid to oil ratio employed can vary from about 0.01 up to about 0.10 volumes of acid per volume of oil and preferably is in the range from about 0.02 up to about 0.06 volumes of acid per volume of oil. The acid contacting step can be conducted as either a continuous or batch operation. Generally, no more than 20 percent of the acid is consumed in the single acid "dump". Usually, acid consumption will be less than 15 percent and advantageously is most often less than about 10 percent.

Subsequent to the acid treatment step of our process, the hydrocarbon product material is recovered from the total effluent by separation of the hydrocarbon phase from the acid phase and isolation of the desired white oil from acid sludge and sulfonates. Again, this recovery of product can be conducted as either a continuous or batch operation in accordance with techniques well known in the art including, for example, neutralization, steaming, stripping and clay contacting or percolation.

It may also be desired to treat the hydrogenated oil in a second stage of mild hydrogenation (or hydrofinishing). Catalysts useful for the second stage are generally the same as those suggested above for the first stage. Thus, the second stage of hydrofinishing is typically conducted at temperatures ranging from about 190° C. to about 370° C., at pressures of from about 400 psig to about 3000 psig, at space velocities (LHSV) of from about 0.1 to about 20, and hydrogen recycle rates of from about 400 to about 1500 SCF/bbl. Typically, the reaction temperature in the second stage of hydrofinishing will be no higher, and frequently lower, preferably at least 25° F., than the reaction temperature in the first hydrofinishing stage.

The hydrogenation catalyst employed in the second stage of hydrofinishing must be particularly active in removing residual aromatics remaining in the oil following the first hydrofinishing stage. Suitable hydrogenation catalysts for the second stage of hydrofinishing include conventional, metallic hydrogenation catalysts, particularly the Group VIII metals such as cobalt, nickel, palladium and platinum. The metals are typically associated with carriers such as bauxite, alumina, silica gel, silica-alumina composites, and crystalline aluminosilicate zeolites. Palladium is a particularly preferred hydrogenation metal. If desired, non-noble Group VIII metals can be used with molybdates. Metal oxides or sulfides can be used.

Preparing the Refinery Stream by Hydrocracking

In a preferred embodiment, the hydrocarbon oil feedstock to the catalytic dewaxing/isomerization process is a distillate fraction of a hydrocracked oil.

In commercial operations, hydrocracking can take place as a single step process, or as a multi-step process using initial denitrification or desulfurization steps, all of which are well known.

Typically, hydrocracking process conditions include temperatures in the range of 250° C. to 500° C., pressures in the range of about 425 to 3000 psig, or more, a hydrogen recycle rate of 400 to 15,000 SCF/bbl, and a LHSV (v/v/hr) of 0.1 to 50.

During the hydrocracking step, there are conversions of at least 10% to products boiling below 350° C. Catalysts employed in the hydrocracking zone or zones include those having hydrogenation-dehydrogenation activity, and active cracking supports. The support is often a refractory inorganic oxide such as silica-alumina, silica-alumina-zirconia and silica-alumina-titania composites, acid-treated clays, crystalline aluminosilicate zeolitic molecular sieves (such as Zeolite A, faujasite, Zeolite X and Zeolite Y), and combinations of the above.

Hydrogenation-dehydrogenation components of the hydrocracking catalyst usually comprise metals selected from Group VIII and Group VIB of the Periodic Table, and compounds including them. Preferred Group VIII components include cobalt, nickel, platinum and palladium, particularly the oxides and sulfides of cobalt and nickel. Preferred Group VIB components are the oxides and sulfides of molybdenum and tungsten. Thus, examples of hydrocracking catalysts which are preferred for use in the hydrocracking step are the combinations nickel-tungsten-silica-alumina and nickel-molybdenum-silica-alumina.

Hydrocracking catalysts can vary in their activities for hydrogenation and cracking and in their ability to sustain high activity during long periods of use depending upon their compositions and methods of preparation. There are any number of catalysts which are known to the art and which can be selected for use in the hydrocracking step based on operating conditions and feeds to optimize the hydrocracking operation.

The hydrocracking process step is performed to yield a hydrocrackate having a total nitrogen content preferably of less than about 50 ppm (w/w). Standard hydrocracking procedures can easily achieve this nitrogen level, especially where the feed is subject to an initial partial denitrification process. Preferably, the nitrogen content of the hydrocrackate is as low as is consistent with economical refinery operations, but is preferably less than 10 ppm and more preferably less than about 1 ppm (w/w).

The hydrocracking step yields three significant benefits. First, by lowering the nitrogen content, it dramatically increases the efficiency and ease of the catalytic dewaxing step. Second, the viscosity index is greatly increased as the aromatic compounds present in the feed, especially the polycyclic aromatics, are opened and hydrogenated. In the hydrocracking step, increases of at least 10 VI units will occur in the white oil fraction, i.e., that fraction boiling above 230° C. and more preferably above 315° C. Third, aromatics, heteroatoms, and other molecules which are detrimental to white mineral oils are largely removed during hydrocracking.

The hydrocrackate is preferably distilled by conventional means to remove those products boiling below 230° C., and more preferably below 315° C. to yield one or more white oil boiling range streams. Depending upon the viscosity grade of white oil desired, the raw hydrocrackate may be fractionally distilled into light, medium or heavy oil fractions. Among the lower boiling products removed are light nitrogen containing compounds such as $NH_3$. This yields a feedstock with a reduced nitrogen level, so that the crystalline silicoaluminophosphate SAPO-11 in the dewaxing catalyst achieves maximum activity in the dewaxing step. Lubricating oil feedstocks of different boiling ranges can be prepared by the process of this invention. These would include light neutral, medium neutral, heavy neutral and bright stock, where the neutral oils are prepared from distillate fractions and bright stock from residual fractions.

The great efficiency of the present invention comes in part from the combination of hydrocracking to produce a very low nitrogen, high viscosity index stock which is then extremely efficiently dewaxed to achieve a very low pour point and improved viscosity and viscosity index. It can be appreciated that the higher the activity of the dewaxing catalyst, the lower the reactor temperature necessary to achieve a particular degree of dewaxing. A significant benefit is, therefore, the greater energy savings from using the enhanced efficiency catalyst and usually longer cycle life. Additionally, since the crystalline silicoaluminophosphate SAPO-11 dewaxing catalyst is shape-selective, it reacts preferentially with the waxy components of the feedstock responsible for high pour points, i.e., the normal paraffins as well as the slightly branched paraffins and alkyl substituted cycloparaffins which comprise the so-called microcrystalline wax.

The invention will be further clarified by the following examples, which are intended to be purely exemplary of the invention.

EXAMPLES

A dewaxed oil was prepared according to the present invention by dewaxing a hydrocracked feedstock having the following properties:

| | |
|---|---|
| Gravity, °API | 34.6 |
| Viscosity @ 100° C. | 5.596 cSt |
| Pour Point | 42° C. |
| Nitrogen | 0.3 ηg/μl |
| Sulfur | 6.0 ppm |
| Saturate Compound Type (D 2786) | |
| Paraffin | 33.7 LV % of Total |
| 1-Ring | 34.1 |
| 2-Ring | 16.3 |
| 3-Ring | 6.6 |
| 4+-Ring | 3.1 |
| Monoaromatics | 0.6 |
| Simulated (D2887) Distillation | |
| 5% | 722° F. |
| 30% | 812° F. |
| 50% | 852° F. |
| 70% | 889° F. |
| 95% | 977° F. |

The hydrocracked feedstock was contacted with SAPO-11 containing catalyst, which was prepared as follows:

A SAPO-11 intermediate pore molecular sieve was prepared using the method disclosed in U.S. Pat. No. 5,208,005, and identified as such by X-ray diffraction analysis. Elemental analysis of the calcined sieve showed it to have the following anhydrous molar composition:

$$.21SiO_2: Al_2O_3: P_2O_5$$

The sieve was bound with 35% Catapal alumina and made into 1/16 inch extrudate. The extrudate was dried four hours at 250° F., calcined in air for four hours at 850° F., then impregnated with 1 weight percent Pt (as $Pt(NH_3)_4Cl_2.H_2O$) by the pore-fill method. It was then dried overnight at 275° F. and calcined in air for eight hours at 850° F.

Product properties of the dewaxed oil prepared according to the present invention are shown in Table VII below.

A comparative solvent dewaxed oil was prepared by solvent dewaxing the hydrocracked feedstock described above using a 4/1 solvent to oil volumetric ratio of a 1:1 toluene:methylethyl ketone solvent blend. The wax was crystallized by cooling the oil and solvent solution overnight at between −15° F. and −20° F. Wax was removed by filtering the solution, and the solvent was stripped off by distillation. Product properties of the solvent dewaxed oil are shown in Table VII.

TABLE VII

| | Solvent Dewaxing | Dewaxing According to this Invention |
|---|---|---|
| Pour Point, °C. | +15 | +15 |
| Viscosity Index | 120 | 121 |
| Saturate Compound Type, LV % of Total, D 2786 | | |
| Paraffin | 29.6 | 34.4 |
| 1-Ring | 34.5 | 35.4 |
| 2-Ring | 16.7 | 18.4 |
| 3-Ring | 6.5 | 6.7 |
| 4+-Ring | 3.3 | 3.0 |
| Monoaromatics | 0.6 | 0.3 |

A sample of each of the dewaxed oil of this process and the solvent dewaxed oil are then treated with bauxite.

A bauxite filter is prepared as follows. A sample of bauxite is dried at 400° F. for 20 hours, and sifted through a mesh screen. 400 g of the dried and sifted bauxite are added to 600 grams of warmed dewaxed oil. A 1" layer of test oil is added to a cleaned 2" glass column, and 1" of spun glass is added to the column. The bauxite/oil mix is then added to the column.

The dewaxed sample is then filtered through the bauxite as follows. The column is placed in an oven heated at 180° F. After one hour, test oil is filtered through the column at about 600 g/hour, and the oil is run for one hour. During the first hour, the oil collected from the column is returned to the feed tank. At the end of an hour, samples are collected and analyzed. The oils are found to pass specifications for technical grade white oils and food grade white oils. Furthermore, while the pour points of the solvent dewaxed oil and the oil of the present process have the same pour point, indicating that they have the same normal paraffin content, the isoparaffin content of the oil of the present process is found to be higher than the isoparaffin content of the conventional solvent dewaxed oil.

What is claimed is:

1. A process for producing an isoparaffin white oil comprising:

a. contacting, under dewaxing conditions, a refinery stream boiling above 350° F. and containing straight chain and slightly branched chain hydrocarbons in the presence of added hydrogen with a catalyst comprising:
   i. an intermediate pore size silicoaluminophosphate molecular sieve, and
   ii. a hydrogenation component; to produce a dewaxed oil product;

b. contacting said dewaxed oil product under hydrogenation conditions in the presence of a hydrogenation catalyst to produce a hydrogenated oil product; and c. treating said hydrogenated oil product at aromatics removal conditions to produce an isoparaffin white oil containing an isoparaffin/total paraffin weight ratio of greater than about 0.4/1.

2. The process of claim 1 wherein said dewaxing conditions include a reaction temperature of from about 200° C. to 475° C., a reaction pressure of about 15 psig to about 3000 psig, a liquid hourly space velocity of from about 0.1 $hr^{-1}$ to about 20 $hr^{-1}$, a hydrogen circulation rate of from 500 to about 30,000 SCF/bbl.

3. The process of claim 1 wherein the intermediate pore size silicoaluminophosphate molecular sieve is SAPO-11.

4. The process of claim 1 wherein the intermediate pore size silicoaluminophosphate molecular sieve is SAPO-31.

5. The process of claim 1 wherein the intermediate pore size silicoaluminophosphate molecular sieve is SAPO-41.

6. The process of claim 1 wherein the hydrogenation component is a Group VIII metal.

7. The process of claim 6 wherein the hydrogenation component is selected from the group consisting of platinum and palladium.

8. The process of claim 7 wherein the hydrogenation component is platinum.

9. The process of claim 1 wherein the dewaxed oil product has a pour point of less than 10° C.

10. The process of claim 1 wherein said hydrogenation conditions include a reaction temperature of from about 190° C. to about 370° C., a reaction pressures of from about 400 psig to about 3000 psig, a liquid hourly space velocity of from about 0.1 $hr^{-1}$ to about 20 $hr^{-1}$, and a hydrogen recycle rate of from about 400 to about 1500 SCF/bbl.

11. The process of claim 10 wherein said hydrogenation catalyst comprises palladium.

12. The process of claim 1 wherein said treating step comprises a second hydrogenation stage.

13. The process of claim 12 wherein said second hydrogenation stage is conducted in the presence of a hydrogenation catalyst at a temperature in the range from about 190° C. to about 370° C. and at a pressure in the range from about 400 psig to about 3000 psig to produce the hydrogenated oil product.

14. The process of claim 13 wherein the temperature of said second hydrogenation stage is less than the temperature of said first hydrogenation stage.

15. The process of claim 1 wherein said treating step comprises an acid treating step.

16. The process of claim 15 wherein the acid treating step comprises contacting the hydrogenated oil product with sulfuric acid containing up to about 20 percent free $SO_3$, said contacting being conducted at a temperature in the range from about 80° F. to about 250° F. and at a dosage rate of from about 0.01 to about 0.10 volumes of acid per volume of oil.

17. The process of claim 1 wherein said treating step comprises passing the hydrogenated oil product through a bed of solid adsorbent at a temperature in the range of from 35° C. to 300° C.

18. The process of claim 1 wherein the isoparaffin white oil has a viscosity in the range of 8 to 10 cSt at 40° C.

19. The process of claim 1 wherein the isoparaffin white oil has a viscosity in the range of 10 to 18 cSt at 40° C.

20. The process of claim 1 wherein the isoparaffin white oil has a viscosity in the range of 18 to 21 cSt at 40° C.

21. The process of claim 1 wherein the isoparaffin white oil has a viscosity in the range of 21 to 45 cSt at 40° C.

22. The process of claim 1 wherein the isoparaffin white oil has a viscosity in the range of 45 to 49 cSt at 40° C.

23. The process of claim 1 wherein the isoparaffin white oil has a viscosity in the range of 49 to 90 cSt at 40° C.

24. The process of claim 1 wherein the isoparaffin white oil has a viscosity in the range of 90 to 110 cSt at 40° C.

25. The process of claim 1 wherein the isoparaffin white oil has a viscosity greater than 110 cSt at 40° C.

26. The process of claim 1 wherein the isoparaffin white oil meets the requirements of 21 CFR 178.3620(c).

27. The process of claim 26 wherein the isoparaffin white oil meets the requirements of 21 CFR 178.3620(b).

28. The process of claim 27 wherein the isoparaffin white oil meets the requirements of 21 CFR 178.3620(a).

29. The process of claim 28 wherein the isoparaffin white oil meets the requirements of 21 CFR 172.878.

30. The process of claim 1 wherein the refinery stream is a hydrocracked stock.

31. The process of claim 30 wherein said hydrocracked stock is prepared by contacting a hydrocarbon feed with a hydrocracking catalyst at hydrocracking conditions, including a temperature in the range of 250° C. to 500° C., a pressure in the range of about 425 to 3000 psig, a hydrogen recycle rate in the range of 400 to 15,000 SCF/bbl, and a LHSV (v/v/hr) in the range of 0.1 to 50.

32. The product obtained by the process of claim 1.

* * * * *